US006428309B1

(12) United States Patent
Doiron

(10) Patent No.: US 6,428,309 B1
(45) Date of Patent: Aug. 6, 2002

(54) UTILITY LIGHTER

(75) Inventor: Gerald J. Doiron, Marco Island, FL (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/510,304

(22) Filed: Feb. 22, 2000

(51) Int. Cl.[7] ..... F23Q 7/12; F23D 11/36

(52) U.S. Cl. ..... 431/153; 431/255; 431/266; 431/264; 431/345; 431/344

(58) Field of Search ..... 431/153, 255, 431/344, 345, 266, 264, 277, 276, 142, 126, 125; 126/25 B; D7/416

(56) References Cited

U.S. PATENT DOCUMENTS

| | | | | |
|---|---|---|---|---|
| 2,679,740 A | * | 6/1954 | Seletzky | 431/142 |
| 3,544,252 A | | 12/1970 | Quednow | 431/253 |
| 3,580,983 A | | 5/1971 | Jackson | 174/47 |

(List continued on next page.)

FOREIGN PATENT DOCUMENTS

| | | | | |
|---|---|---|---|---|
| CH | 664208 | * | 2/1988 | 431/344 |
| DE | 3332335 | * | 3/1985 | 431/344 |
| EP | 0 222 336 | | 7/1986 | |
| EP | 660 045 | | 12/1994 | |
| FR | 2399619 | * | 4/1979 | 431/255 |
| GB | 2156499 | | 10/1985 | |
| JP | 06307638 | * | 1/1994 | 431/255 |
| JP | 8-110046 A | | 4/1996 | |
| JP | 11-108357 A | | 4/1999 | |
| WO | WO-97/06388 | * | 2/1997 | |

OTHER PUBLICATIONS

"E–Z Light" lighter (Exhibits 1–4), circa 1986–1988.

Flexi Flame, Versatile Lighter FLX001, publication date is at least Oct. 25, 1999.

*Primary Examiner*—Carl D. Price
(74) *Attorney, Agent, or Firm*—Pennie & Edmonds LLP

(57) ABSTRACT

A utility lighter (10), which utilizes the fuel, the actuation mechanism (22, 24, 26, 28, 30) and/or the child-resistant mechanism of a pocket lighter (16), is disclosed. The utility lighter is sized and dimensioned to receive the pocket lighter. The utility lighter also defines a cut-out portion (44, 46) on its housing to expose the actuation mechanism and/or the child-resistant mechanism therethrough for user manipulation.

25 Claims, 4 Drawing Sheets

U.S. PATENT DOCUMENTS

| | | | | | |
|---|---|---|---|---|---|
| 4,133,450 | A | * | 1/1979 | Beeson et al. | 431/142 |
| 4,222,734 | A | * | 9/1980 | Nolf | 431/344 |
| 4,253,820 | A | * | 3/1981 | Jarreau | 431/344 |
| 4,259,059 | A | | 3/1981 | Roosa et al. | 431/254 |
| 4,389,187 | A | | 6/1983 | Sims | 431/277 |
| 4,462,791 | A | | 7/1984 | Hayden | 431/345 |
| 4,522,583 | A | * | 6/1985 | Kraser | 431/125 |
| 4,610,624 | A | * | 9/1986 | Bruhn | 431/255 |
| 4,640,679 | A | * | 2/1987 | Perrin | 431/146 |
| 4,799,877 | A | | 1/1989 | Bisbee | 431/153 |
| 4,901,848 | A | | 2/1990 | Parren | 206/86 |
| 4,904,180 | A | | 2/1990 | Nitta | 431/153 |
| 5,082,440 | A | | 1/1992 | Yamamoto | 431/143 |
| 5,120,215 | A | * | 6/1992 | Nollas | 431/153 |
| 5,145,358 | A | | 9/1992 | Shike et al. | 431/153 |
| 5,222,889 | A | | 6/1993 | Hsu | 431/255 |
| 5,228,849 | A | | 7/1993 | Frigiere | 431/255 |
| 5,240,408 | A | | 8/1993 | Kenjiro et al. | 431/153 |
| 5,262,697 | A | | 11/1993 | Meury | 310/339 |
| 5,284,439 | A | * | 2/1994 | Shike et al. | 431/255 |
| 5,304,060 | A | | 4/1994 | Lin | 431/255 |
| 5,445,518 | A | | 8/1995 | McDonough et al. | 431/153 |
| 5,458,482 | A | | 10/1995 | Saito et al. | 431/153 |
| 5,460,520 | A | | 10/1995 | Lin | 431/255 |
| 5,462,432 | A | | 10/1995 | Kim | 431/153 |
| 5,479,914 | A | * | 1/1996 | Tsai | 126/401 |
| 5,505,614 | A | | 4/1996 | Lin | 431/143 |
| 5,513,980 | A | | 5/1996 | Rasmussen et al. | 431/153 |
| 5,531,591 | A | | 7/1996 | Yamazaki | 431/153 |
| 5,531,592 | A | | 7/1996 | Tasi | 431/255 |
| 5,584,682 | A | | 12/1996 | McDonough et al. | 431/153 |
| 5,667,377 | A | | 9/1997 | Lin | 431/344 |
| 5,738,507 | A | | 4/1998 | Mifune et al. | 431/255 |
| 5,741,128 | A | | 4/1998 | Tsai | 431/153 |
| 5,788,476 | A | | 8/1998 | Sher | 431/153 |
| 5,800,155 | A | | 9/1998 | Miyanaga | 431/153 |
| 5,833,448 | A | | 11/1998 | Doucet et al. | 431/153 |
| 5,839,892 | A | | 11/1998 | Hwang | 431/153 |
| 5,854,530 | A | | 12/1998 | LaForest et al. | 310/339 |
| 5,885,069 | A | | 3/1999 | Rogelet | 431/153 |
| 5,885,070 | A | | 3/1999 | Lin | 431/255 |
| 5,901,881 | A | * | 5/1999 | Wang | 222/113 |
| 5,921,768 | A | * | 7/1999 | Joncg | 431/255 |
| 5,934,895 | A | | 8/1999 | McDonough et al. | 431/255 |
| 5,996,243 | A | * | 12/1999 | Chang et al. | 125/401 |
| 6,010,328 | A | * | 1/2000 | Sung | 431/153 |
| 6,077,071 | A | * | 6/2000 | Yeh | 431/153 |
| 6,086,359 | A | * | 7/2000 | Sher | 431/153 |

* cited by examiner

UTILITY LIGHTER

TECHNICAL FIELD

The present invention generally relates to general purpose utility lighters, such as those used to ignite candles, barbecue grills, fireplaces and campfires.

BACKGROUND OF THE INVENTION

Lighters such as those used for igniting purposes, for example, relying on a fuel container, have developed over a number of years. Typically, these lighters use either a rotary friction element or a piezoelectric ignition device to generate a spark in proximity to a nozzle emitting the fuel. Piezoelectric ignition devices have gained universal acceptance because they are simple to use. One such piezoelectric ignition device is disclosed in U.S. Pat. No. 5,262,697 (the '697 patent). The disclosure of the '697 patent is hereby incorporated by reference herein.

Lighters have also evolved from the small pocket lighters to several forms of extended lighters that are more useful for general purposes, such as lighting candles, barbecue grills, fireplaces and campfires. Earlier attempts at such designs relied simply on extended actuating handles to house a typical lighter at the end. Examples of this design are found in U.S. Pat. Nos. 4,259,059 and 4,462,791.

In addition, many of the general purpose lighters have had some form of shut-off mechanism for resisting undesired operation of the lighter by young children. Often, these mechanisms take the form of on/off switches that may shut off the fuel source or may prevent movement of an actuator, such as a push-button, on the lighter. Moreover, the on/off switches that must be affirmatively moved by the user between the "on " and "off" positions have drawbacks. For example, an adult user may forget to move the switch back to the "off" position after use, thereby allowing undesired operation.

One solution that overcomes the drawback of a user forgetting to return the on/off switch to the off position is to utilize a biased latch that only allows operation of the lighter when the latch is moved into a position out of interference with the valve actuator. Once the valve actuator is depressed and released, the latch returns to its inoperative or latched position automatically so that subsequent use of the lighter again requires moving the latch out of interference with the valve actuator. Examples of such a device are found in U.S. Pat. Nos. 5,445,518 and 5,584,682.

Other utility lighters incorporate a pocket lighter only as a fuel source and have an actuating trigger and child-resistant mechanism, in addition to the pocket lighter's actuating mechanism. An example of this design is illustrated in GB 2,156,499A.

There remains a need for a utility lighter that can directly utilize the fuel, the push-button and/or child-resistant mechanism from a pocket lighter.

SUMMARY OF THE INVENTION

It is one object of this invention is to provide a utility lighter capable of resisting undesired operation.

Another object of the invention is to incorporate a pocket lighter into a housing to form a utility lighter.

Another object of the invention is to utilize the actuating mechanism of the pocket lighter as the actuating mechanism of the utility lighter.

A further object of the invention is to utilize the child-resistant mechanism of the pocket lighter as the child-resistant mechanism of the utility lighter.

Another object of the invention is to utilize the actuating mechanism and the child-resistant mechanism from the pocket lighter as the actuating trigger and the child-resistant mechanism of the utility lighter.

Another advantage of the invention is that the housing of the utility lighter may have any interchangeable aesthetically pleasing shape, so long as the housing is adapted to incorporate the pocket lighter.

These objects and advantages and other objects and advantage are accomplished in a flame producing apparatus comprising a body, which is sized and dimensioned to receive a lighter and is connected to a wand. The lighter comprises a piezoelectric ignition device and a fuel source in fluid communication with a valve movable between a closed position and an open position. The valve and ignition device are actuatable by a push-button to selectively release fuel and to produce a spark. The push-button is sized and dimensioned to extend through a cut-out portion on the body for user manipulation. The flame producing apparatus further comprises an inner tube disposed within the wand and is in fluid communication with the valve of the lighter and a nozzle. The wand and the inner tube are electrically coupled to the ignition device such that the spark is produced proximate the nozzle when the ignition device is actuated.

The lighter is preferably a child-resistant lighter, which may comprise a latch member movable between an inoperative position where the latch member interferes with the actuation of the push-button and an operative position where the latch member does not interfere with the push-button. In the inoperative position, the latch member is positioned between the push-button and the lighter housing to interfere with the actuation of the push-button. Furthermore, the body of the flame producing apparatus may also define a second cut-out portion sized and dimensioned to expose the latch member of the child-resistant lighter for user actuation.

BRIEF DESCRIPTION OF THE DRAWINGS

To facilitate the understanding of the characteristics of this invention, the following drawing figures have been provided, wherein.

DESCRIPTION OF THE PREFERRED EMBODIMENTS

Figure 1:
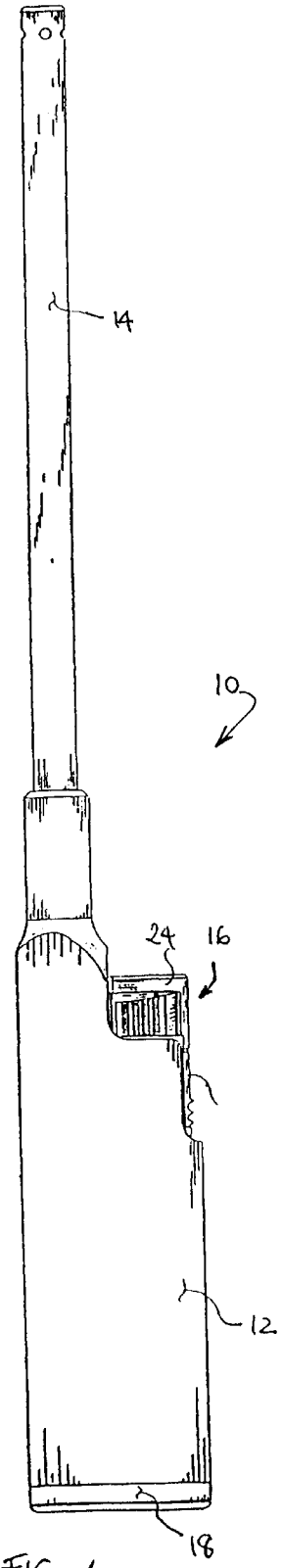
FIG. 1 is a front view of a first embodiment of a utility lighter of the present invention.

FIGS. 1–5 generally describe the first embodiment of utility lighter 10 in accordance to the present invention.

Lighter 10 comprises a housing 12, a conductive wand 14, and a pocket lighter 16. The pocket lighter 16 is sized and dimensioned to be inserted into the housing 12. An end cap 18 is adapted to fit into the back end of housing 12 to retain pocket lighter 16 inside the housing. Alternatively, the housing may be formed from two equal halves.

As illustrated, pocket lighter 16 is substantially a standard piezoelectric lighter, which comprises a housing 20 containing a fuel reservoir, a piezoelectric element 22 and a push-button 24. As used herein, the term lighter refers to any lighter, which has at least a fuel reservoir, a piezoelectric element and a push-button, and is capable of producing a flame. The fuel reservoir is in fluid communication with a gas valve 26, which preferably includes a valve and a movable jet. Valve 26 is movable between an open position and a closed position to selectively release fuel. The piezoelectric element 22 is preferably connected to push-button 24, such that when a user pushes the push-button the piezoelectric element 22 is compressed to produce an electrical charge. In the pocket lighter 16, the electrical charge is conducted to electrode 28 and to valve 26, or a conductive diffuser spring attached to valve 26, to generate a spark therebetween. As the push-button compresses the piezoelectric element 22, the push-button also acts on biased pivotal arm 30, which is operatively connected to valve 26 to lift the valve to selectively release fuel to be ignited by the spark generated across the gap between the valve 26 and the electrode 28. Pocket lighter 16, as described thus far, is substantially similar to the lighter illustrated in the '697 patent and in U.S. Pat. No. 5,854,530. The disclosures of the '697 patent has previously been incorporated by reference, and the disclosure of the '530 patent is hereby incorporated by reference in its entirety.

Figure 2:
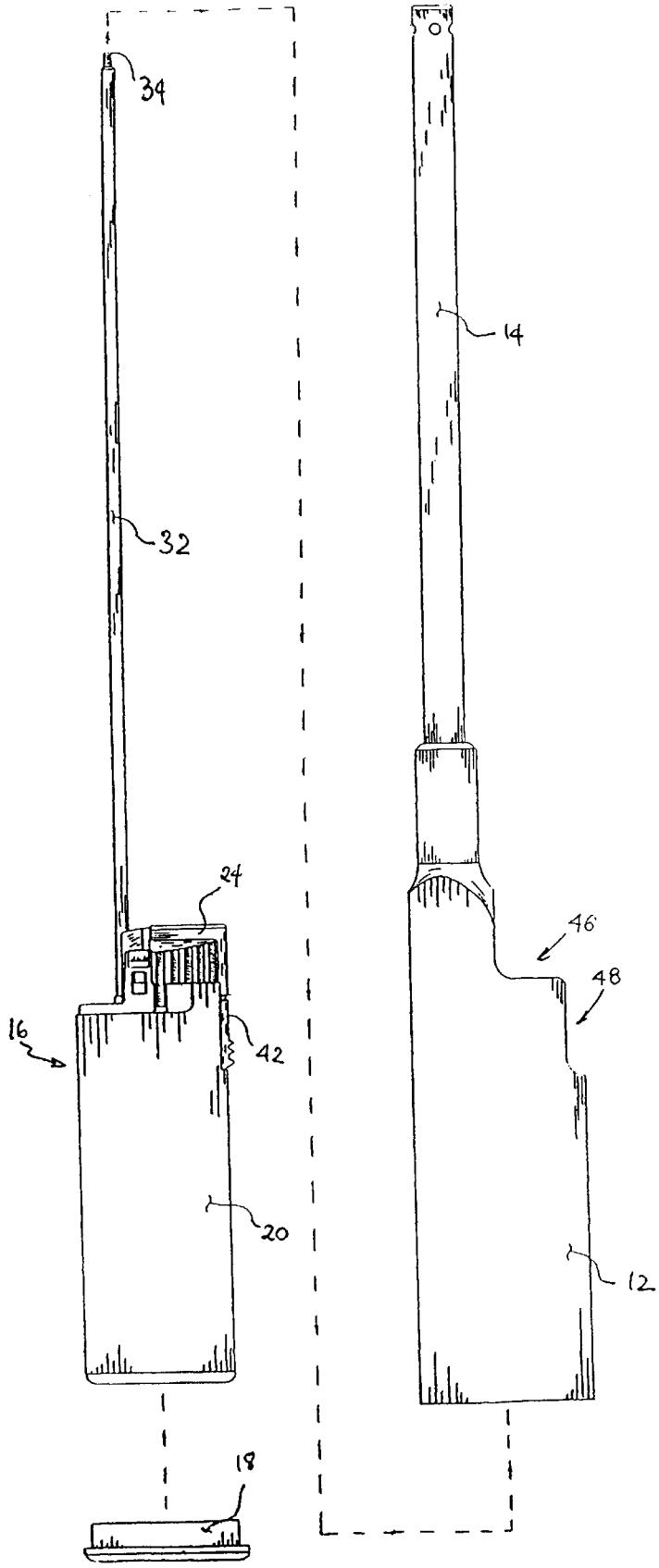
FIG. 2 is an exploded view of the utility lighter of FIG. 1.

As shown in FIG. 2, an elongated fuel conduit 32 is connected to gas valve 26 at one end to communicate the fuel released from pocket lighter 16 to the front end of the wand 14. Conduit 32 can be either rigid or flexible and terminates at a nozzle 34, which may include a diffuser spring, at the opposite end. Furthermore, conduit 32 can have any shape or configuration as long as it communicates the fuel released from valve 26 to nozzle 34, and conducts the electricity from valve 26 or the diffuser spring attached thereto to nozzle 34. For example, conduit 32 may be constructed from an electrically conductive metal or a pliable conductive rubber. Conduit 32 may also comprise a conductive member, such as a metal wire, disposed inside an insulated tube. Alternatively, the conductive member may be embedded within the wall of the insulated tube. The conductive member may also be a portion of the wall of the insulated tube. The conductive member may comprise a plurality of wires disposed either inside the tube or within the wall of the tube. Additionally, the conductive member can also be a mesh or woven wire or a conductive tube disposed concentrically with respect to the insulated tube. These shapes and configurations are known in the art and are illustrated in EP 222 336 A1 publication, among other references. Alternatively, an insulated conductive wire may be used, as illustrated in U.S. Pat. No. 5,934,895. Of course, the insulated wire can be positioned inside or outside of the conduit.

Figure 3:
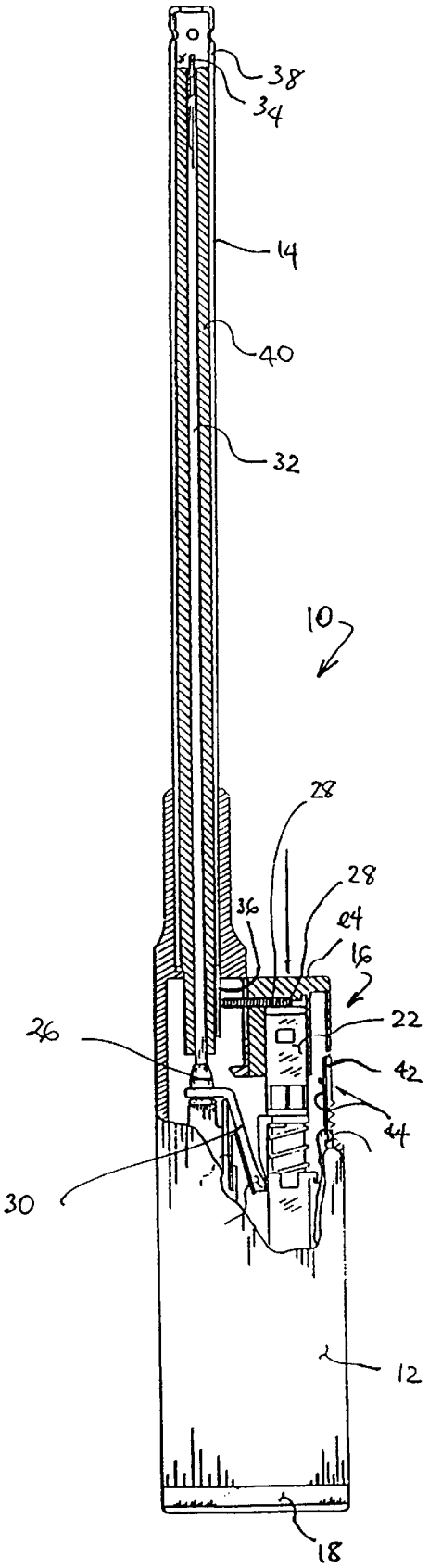
FIG. 3 is a partial cross-sectional view of the utility lighter of FIG. 1 showing the utility lighter in the inoperative position.
Figure 4:
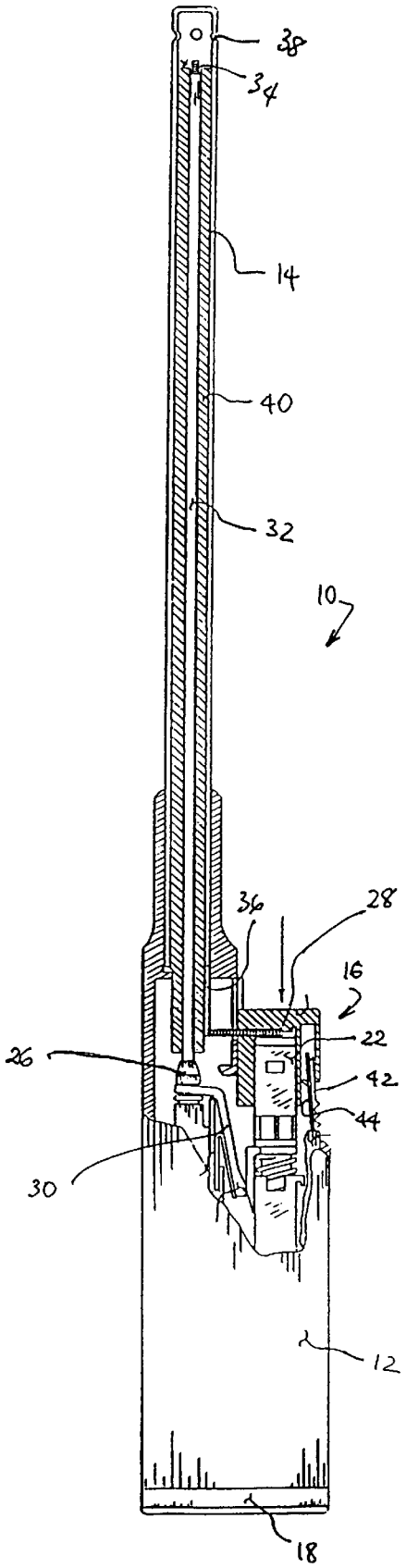
FIG. 4 is a partial cross-sectional view of the utility lighter of FIG. 1 showing the utility lighter in the operative position.
Figure 8:
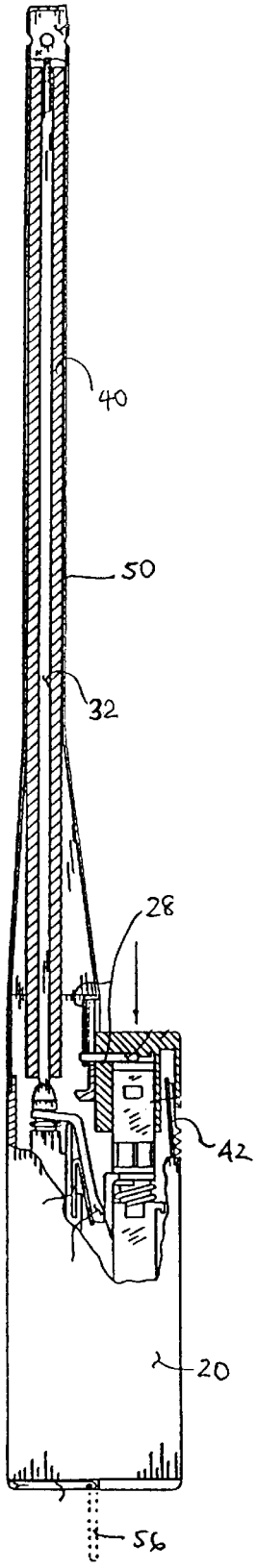
FIG. 8 is a partial cross-sectional view of the utility lighter of FIG. 6 showing the lighter in the operative position.
Figure 6:
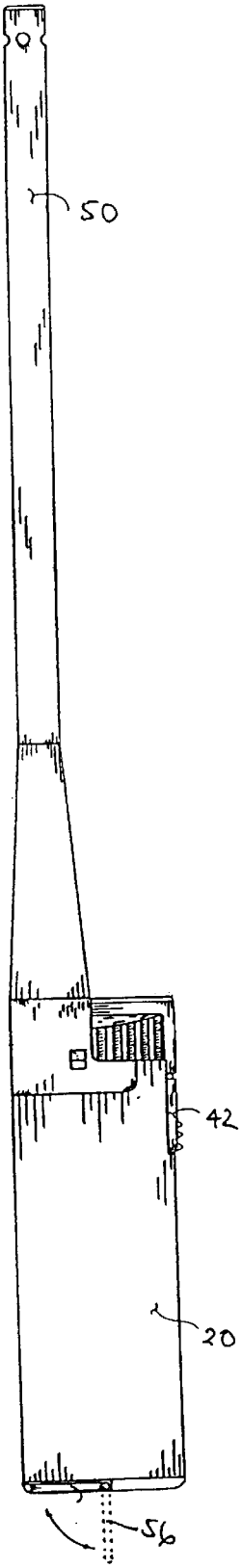
FIG. 6 is a front view of a second embodiment of a utility lighter of the present invention.
Figure 7:
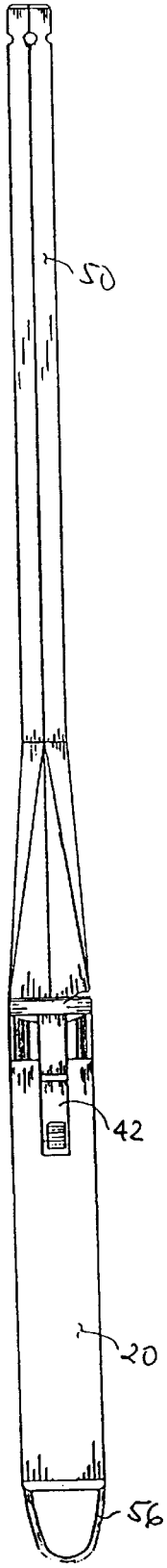
FIG. 7 is a side view of the utility lighter of FIG. 6.
Figure 9:
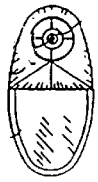
FIG. 9 is an end view of the utility lighter of FIG. 6.
Figure 5A:
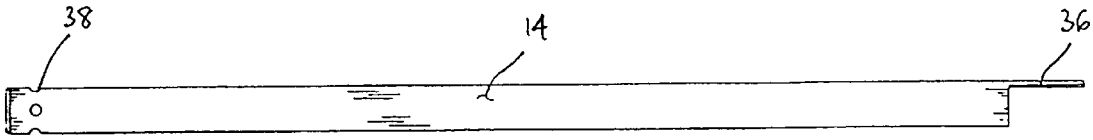
FIG. 5(*a*) is a front view of a conductive shell, and FIG. 5(*b*) is a partial top view of the conductive shell.
Figure 5B:
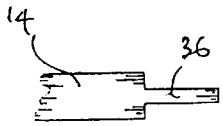

Preferably, the wind guard on the lighter is removed before the conduit is connected to the valve. The pocket lighter and the conduit are then inserted into the housing 12 and electrically conductive wand 14, as illustrated in FIGS. 2–4. As shown in FIGS. 3, 4, 5(*a*) and 5(*b*), wand 14 has extension 36 which is disposed within the housing 12. Electrode 28 of pocket lighter 16 is sized and dimensioned to maintain sliding contact with extension 36 when the piezoelectric element is being compressed, such that the electrical charge from electrode 28 is conducted through wand 14 to front electrode 38. Preferably, electrode 28 is in contact with extension 36 when the electrical charge is generated. On the other hand, as discussed above conduit 32 and nozzle 34 are preferably electrically conductive to communicate the electrical charge from valve 26 to nozzle 34. The spark generated between nozzle 34 and front electrode 38 would ignite the fuel released from nozzle 34 to produce a flame.

Preferably, a hollow insulated sleeve 40, as shown in FIGS. 3 and 4, is disposed between wand 14 and nozzle to prevent the spark from occurring anywhere except between nozzle 34 and front electrode 38. Alternatively, as shown in the '895 patent, the housing 12 may extend to the front end of the lighter and wand 14 can be disposed on the outside of the extended portion of the housing. In this case, the extended portion of the housing electrically insulated the conductive wand from the conduit 32.

Pocket lighter 16 also preferably comprises a child-resistant mechanism, such as a latch 42 disposed between the push-button 24 and housing 20 of the pocket lighter. Latch 42 is biased by a spring 44 to an inoperative position, where it prevents the actuation of the push-button, as shown in FIG. 3. A user may move latch 42 against the biasing force of spring 44 to an operative position, where actuation of the push-button is allowed. For the exemplary lighter 16 illustrated in FIG. 3, movement of latch 42 in the inward direction, i.e., toward the valve 26, place the lighter 16 in the operative position. Further upward movement of latch 42, i.e., toward push-button 24, temporarily holds latch 42 in the operative position. After the user depresses and releases the push-button, spring 44 biases the latch 42 back to the inoperative position.

The structure and operation of latch 42 as illustrated herein are fully described in U.S. Pat. Nos. 5,445,518 and 5,584,682. The disclosures of the '518 and '682 patents are hereby incorporated by reference in their entirety. Other piezoelectric child-resistant lighters with a child-resistant latch can be used in conjunction with the utility lighter 10 of the present invention. For example, the piezoelectric lighters with child-resistant latch disclosed in, but not limited to, U.S. Pat. Nos. 5,531,591, 5,458,482, 5,240,408, 5,145,358, 4,904,180, 5,462,432, 5,788,476, 5,839,892, 4,904,180, and 5,228,849 are usable in the present invention. Other child-resistant piezoelectric lighters without a latch, such as U.S. Pat. Nos. 5,885,069, 5,854,530, 5,833,448 and others can also be used. Other lighters can also be used, as long as it has a piezoelectric mechanism actuatable by a push-button. The push-button may also be a single trigger, or the push-button may comprise a gas release member and a separate a spark generating member.

Housing 12 preferably has a first cut-out portion 46 sized and positioned to allow the push-button or the push-button and/or latch to expose therethrough for user manipulation. Housing 12 preferably has a second cut-out portion 48 sized and positioned to allow the latch to expose therethrough. Second cut-out portion 48 is not required when utility lighter 10 is used with a latch-less child-resistant piezoelectric lighter or when the latch is located on the push-button. Cut-outs 46 and 48 are illustrated herein to be proximate to each other. However, cut-outs 46 and 48 can be located anywhere on housing 12 to accommodate the push-button and/or latch on the various pocket lighters.

The operation of the utility lighter 10 of the present invention is substantially identical to the operation of the pocket lighter 16 contained therein, i.e., the user operates the utility lighter the same way that the user would operate the pocket lighter. One of the advantages of the present invention is that the ignition mechanism and/or the child-resistant mechanism of the pocket lighter become the ignition mechanism and/or child-resistant mechanism of the utility lighter.

Figure 10A:
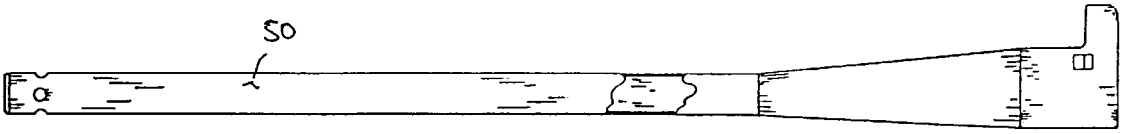
FIG. 10(*a*) is a front view of another conductive shell and FIG. 10(*b*) is a partial perspective view of an end of the conductive shell.
Figure 10B:
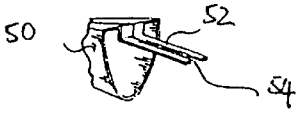

A second embodiment of the utility lighter is shown in FIGS. 6–10, where wand 50 is shown. Wand 50 has extension 52 which defines a slot 54, as shown in FIG. 10(*b*). Electrode 28 of lighter 16 is movably received in slot 54 to maintain electrical contact between electrode 28 and wand 50 when push-button compresses piezoelectric element 22 to generate a spark. A hook 56 is optionally provided.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention. For example, the lighter 16 is illustrated in FIG. 2 without a wind shield, which normally surrounds valve 26. A wind shield may be incorporated to the lighter 16 without departing from the present invention. Furthermore, while one particular shape of housing 12 is illustrated, it is well within the purview of one of ordinary skills in this art to modify the shape of housing 12 to any aesthetically pleasing shape, as long as the housing is sized and dimensioned to receive a lighter such as lighter 16.

What is claimed is:

1. A flame producing apparatus comprising:

a body connected to a wand, said body defines a cut-out portion thereon, said body portion containing a preassembled lighter, said lighter comprises a piezoelectric ignition device and a fuel source in fluid communication with a valve movable between a closed position and an open position, wherein said valve and ignition device are actuatable by a push-button to selectively release fuel and to produce a spark;

said lighter further comprises a latch member movable between a position where the lighter is inoperative and a position where the lighter is operative;

wherein the flame producing apparatus further comprises an inner tube disposed within the wand and is in fluid communication with the valve of the lighter and a nozzle, and wherein the wand and the inner tube are electrically coupled to the ignition device such that the spark is produced proximate the nozzle when the ignition device is actuated;

wherein the cut-out portion on the body is sized and dimensioned to expose the push-button and the latch member for user actuation when the lighter is received inside the body.

2. The flame producing apparatus of claim 1 further comprises an end cap adapted to fit on to a first end of the body to retain the lighter within the body.

3. The flame producing apparatus of claim 2, wherein the nozzle is located at a second end of the inner tube remote from said first end of the body.

4. The flame producing apparatus of claim 1, wherein the piezoelectric ignition device comprises first and second electrodes, said first electrode is electrically coupled to the wand and the second electrode is electrically coupled to the inner tube.

5. The flame producing apparatus of claim 4 further comprises an extension, which electrically couples the wand to the first electrode.

6. The flame producing apparatus of claim 4, wherein the extension is integral with the wand.

7. The flame producing apparatus of claim 5, wherein the first electrode is slidingly connected to the wand.

8. The flame producing apparatus of claim 5, wherein the first electrode is slidingly connected to the extension.

9. The flame producing apparatus of claim 5, wherein the first electrode is movably received in a channel defined by the extension.

10. The flame producing apparatus of claim 1, wherein the inner tube is rigid.

11. The flame producing apparatus of claim 1, wherein the inner tube is flexible.

12. The flame producing apparatus of claim 1, wherein in the inoperative position the latch member is positioned between the push-button and the body.

13. The flame producing apparatus of claim 1, wherein the body defines a second cut-out portion sized and dimensioned to expose the latch member for user actuation.

14. The flame producing apparatus of claim 1, wherein the latch member interferes with the actuation of the push-button in the position where the preassembled lighter is inoperative and does not interfere with the push-button in the position where the preassembled lighter is operative.

15. A flame producing apparatus comprising:

a body connected to a wand, the body containing a preassembled lighter, the preassembled lighter comprises a housing containing a piezoelectric ignition device and a fuel source in fluid communication with a valve moveable between a closed position and an open position, wherein the valve and ignition device are actuatable by a push-button to selectively release fuel and to produce a spark;

the preassembled lighter further comprises a latch member movable between a position where the preassembled lighter is inoperative and a position where the preassembled lighter is operative;

wherein the flame producing apparatus further comprises a tube in fluid communication with the valve of the lighter; and a nozzle in the wand, and wherein the ignition device is electrically coupled such that the spark is produced proximate the nozzle when the ignition device is actuated; wherein the body defines a cut-out portion that is sized and dimensioned to expose the push-button for user actuation when the preassembled lighter is received inside the body;

wherein the body defines a cut-out portion that is sized and dimensioned to expose the latch member for user actuation when the preassembled lighter is received inside the body.

16. The flame producing apparatus according to claim 15 wherein the push-button extends through the cut-out.

17. The flame producing apparatus according to claim 15 wherein the latch member is biased to return to the inoperable position after activation.

18. The flame producing apparatus of claim 15, wherein the latch member interferes with the actuation of the push-button in the position where the preassembled lighter is inoperative and does not interfere with the push-button in the position where the preassembled lighter is operative.

19. A method of manufacturing a flame producing apparatus, comprising the steps of:

(a) providing at least one outer body component, and a wand, the at least one outer body component configured and adapted to form at least a portion of an outer body of the flame producing apparatus, the wand configured and adapted to connect to the outer body;

(b) providing a preassembled lighter, the preassembled lighter comprises a piezoelectric ignition device and a fuel source in fluid communication with a valve moveable between a closed position and an open position, wherein said valve and ignition device are actuatable by a push-button to selectively release fuel and to produce a spark;

the preassembled lighter further comprises a latch member movable between a position where the preassembled lighter is inoperative and a position where the preassembled lighter is operative;

(c) inserting the preassembled lighter into the at least one outer body component, wherein at least one cut-out portion on the at least one body component is sized and dimensioned to expose the push-button and the latch; and (d) mating the valve of the preassembled lighter so that it is in fluid communication with a nozzle in the wand and electrically coupling the ignition device of the preassembled lighter such that the spark is produced proximate to the nozzle when the ignition device is actuated.

20. The method of manufacturing a flame producing apparatus of claim 19, which further comprises an additional step of forming the outer body with at least one additional outer body component.

21. The method of claim 20, wherein the latch member interferes with the actuation of the push-button in the position where the preassembled lighter is inoperative and does not interfere with the push-button in the position where the preassembled lighter is operative.

22. The method of claim 19, wherein the latch member interferes with the actuation of the push-button in the position where the preassembled lighter is inoperative and does not interfere with the push-button in the position where the preassembled lighter is operative.

23. An extended flame producing apparatus comprising:

a body portion connected to a narrower extended wand portion, the body containing a preassembled lighter, the preassembled lighter comprising:

a housing containing a piezoelectric ignition device and a fuel source in communication with a valve moveable between an opened position and a closed position, a push button to selectively actuate the valve and ignition device to release fuel and to produce a spark, and a latch member moveable between a position where the lighter is inoperable and a position where the lighter is operative, wherein the ignition device, fuel source, valve, push button and latch member are preassembled as unit;

wherein the flame producing apparatus further comprises an inner tube disposed within the wand and in fluid communication with the valve of the preassembled lighter and a nozzle, and wherein the wand and the inner tube are electrically coupled to the ignition device such that the spark is produced proximate the nozzle when the ignition device is actuated; and wherein the lighter body has a push button cut-out portion that is sized and dimensioned to expose the push-button for user actuation when the preassembled lighter is received inside the body and the lighter body has a latch member cut-out portion sized and dimensioned to expose the latch member for user actuation when the preassembled lighter is received in the body.

24. A flame producing apparatus comprising:

a body connected to a wand, said body defining a cut-out portion therein, said body containing a preassembled lighter, said lighter comprising:

a piezoelectric ignition device and a fuel source in communication with a valve moveable between an opened position and a closed position, a push button to selectively actuate the valve and ignition device release fuel and to produce a spark, and a latch member moveable between a position where the lighter is inoperable and a position where the lighter is operative, wherein the ignition device, fuel source, valve, push button and latch member are preassembled as unit;

wherein the flame producing apparatus further comprises an inner tube disposed within the wand and in fluid communication with the valve of the preassembled lighter and a nozzle, and wherein the wand and the inner tube are electrically coupled to the ignition device such that the spark is produced proximate the nozzle when the ignition device is actuated; and wherein the push button and latch member of the preassembled lighter are exposed to user actuation through the cut out portion when the preassembled lighter is received in the body.

25. The flame producing apparatus of claim 24 wherein the push button cut-out portion and the latch member cut-out portion are the same cut-out portion.

* * * * *